United States Patent [19]

Himeno et al.

[11] 4,318,006

[45] Mar. 2, 1982

[54] SWITCHING SYSTEM

[75] Inventors: Yoshiharu Himeno; Masaki Kubota, both of Yokohama, Japan

[73] Assignee: Nissan Motor Company, Limited, Yokohama, Japan

[21] Appl. No.: 185,644

[22] Filed: Sep. 9, 1980

[30] Foreign Application Priority Data

Sep. 14, 1979 [JP] Japan ..... 54-117355

[51] Int. Cl.[3] ..... H01H 47/32

[52] U.S. Cl. ..... 307/38; 307/142; 361/193

[58] Field of Search ..... 361/193; 307/38, 142, 307/41, 328

[56] References Cited

U.S. PATENT DOCUMENTS 3,311,795 3/1967 Gilbert ..... 361/193

3,931,481 1/1976 Jackson ..... 361/193 X

*Primary Examiner*—Michael L. Gellner

*Assistant Examiner*—James L. Dwyer

*Attorney, Agent, or Firm*—Thompson Birch, Gauthier & Samuels

[57] ABSTRACT

A switching system is disclosed for selectively connecting a plurality of electric devices to a power source. The system comprises a plurality of switching circuits associated with respective electric devices. Each switching circuit is operable to connect its associated electric device to the power source and simultaneously place the other switching circuits out of operation. Means is provided for holding a switching circuit associated with a first electric device in operation while permitting another electric device to operate when the first electric device is in a predetermined mode of operation.

4 Claims, 1 Drawing Figure

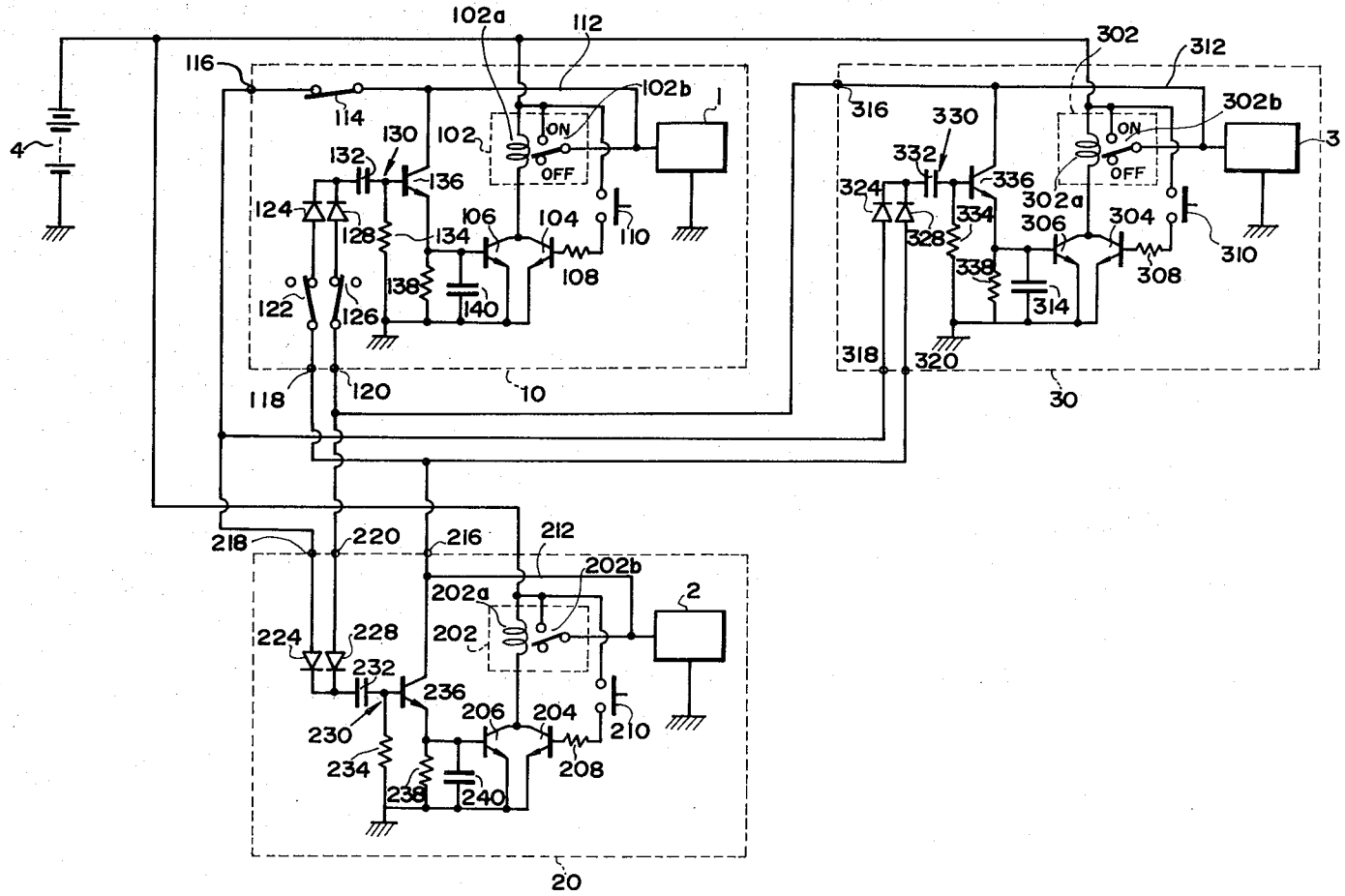
ON
OFF
ON
OFF

SWITCHING SYSTEM

BACKGROUND OF THE INVENTION

1 Field of the Invention

This invention relates to a power system for use in driving a plurality of electric devices such as a tape recorder, radio tuner, and television tuner and, more particularly, to a switching system for selectively connecting such electric devices to a power source.

2. Description of the Prior Art

Normally, electric devices such as tape recorders, radio tuners, television tuners or the like equipped on a road vehicle are powered by the vehicle battery which has a small capacity and is not intended to simultaneously power each such device. Accordingly, it is a common practice to use a switching circuit arranged to prohibit simultaneous operation of two or more of the electric devices.

For example, a switching circuit has been proposed which can selectively connect the car battery to one of the electric devices according to its priority level predetermined therefor according to frequency of use or other criteria. With this prior art switching circuit, any device with a lower priority cannot be powered while an electric device with a higher priority is in use. However, such a conventional switching circuit has had several disadvantages. First, two operations are required to operate the lower priority electric device while the higher priority electric device is in use. That is, the lower priority electric device cannot be placed into operation without turning on the switch associated therewith after turning off the switch associated with the higher priority electric device. Second, although it is possible to operate the higher priority electric device when the lower priority electric device is in use only by turning on the switch associated with the higher priority electric device, the lower priority electric device will automatically operate unnecessarily after the switch associated with the higher priority electric device is turned off if the switch associated with the lower priority electric device remains on.

The present invention provides a switching system which can prevent simultaneous connection of two or more electric devices to a power source but permits connection of one of the electric devices to the power source with another electric device remaining coupled to the power source when the first electric device is in a predetermined mode of operation.

SUMMARY OF THE INVENTION

The invention provides a switching system for selectively connecting a plurality of electric devices to a power source. The system comprises a plurality of switching circuits associated with respective electric devices. Each of the switching circuits is operable to connect its associated electric device to the power source while simultaneously placing the other switching circuits out of operation. Preferably, each switching circuit includes a first switching means having a first condition for connecting its associated electric device to the power source and a second condition for disconnecting the associated electric device from the power source. The first switching means is adapted to alternatively change between the first and second conditions each time a reset signal is applied thereto. Each switching circuit also includes a second switching means for providing a reset signal to the first switching means when actuated, and includes a reset signal generator means responsive to a first condition of the first switching means for providing the reset signal. A third switching means is also provided which, in response to the reset signal from the reset signal generator means of the other switching circuits, provides a reset signal to the first switching means only when the first switching means is in its first condition.

The switching system also comprises a holding circuit for holding a switching circuit associated with one of the electric devices in operation while permitting another switching circuit to operate when the first electric device is in a predetermined mode of operation. The holding circuit may be in the form of switching means responsive to a predetermined mode of operation of one of the electric devices for blocking the reset signal from the reset signal generator means of the switching circuit associated with the first electric device to the other third switching means and also for blocking the reset signal to the third switching means of the switching circuit associated with the first electric device. The first electric device may be a tape recorder, in which case the predetermined mode is the record mode.

BRIEF DESCRIPTION OF THE DRAWING

The details as well as other features and advantages of this invention are set forth below and are shown in the accompanying drawing, in which:

The single FIGURE is a circuit diagram showing one embodiment of a switching system constructed in accordance with the present invention.

DESCRIPTION OF THE PREFERRED EMBODIMENT

Referring to the single FIGURE, there is illustrated a switching arrangement, embodying the present invention, for selectively connecting a plurality of electric devices such as a tape recorder 1, a radio tuner 2, and a television tuner 3 to a battery 4. The switching arrangement comprises first, second and third switching circuits 10, 20 and 30 associated with the tape recorder 1, the radio tuner 2, and the television tuner 3, respectively.

The first switching circuit 10 includes a latch relay 102 having a coil 102*a* and a relay switch 102*b*. The latch relay 102 functions to alternatively change the relay switch 102*b* between its ON and OFF positions each time current flow occurs through the coil 102*a*. The relay switch 102*b* is held in the changed position after the current stops flowing through the coil 102*a* and is changed to the other position by the next current flow through the coil.

The tape recorder 1 is coupled to the battery 4 through the relay switch 102 when in its ON position. The coil 102*a* has one end connected to the battery 4 and the other end grounded through the collector-emitter circuits of transistors 104 and 106 coupled in parallel relationship. The base of the transistor 104 is connected through a resistor 108 to one terminal of a switch 110, the other terminal of which being connected to the battery 4. The switch 110 is of the type which becomes conductive when depressed and becomes non-conductive when released. The power input of the tape recorder 1 is connected through a reset line 112 to one terminal of a switch 114, the other terminal of which being connected to a reset output 116.

The first switching circuit 10 also includes reset inputs 118 and 120. The reset input 118 is connected through a switch 122 and a diode 124 to the input of a differentiating circuit 130, comprising a capacitor 132 and a resistor 134. The other reset input 120 is connected through a switch 126 and a diode 128 to the input of the differentiating circuit 130. The output of the differentiating circuit 130 is coupled to the base of a transistor 136, the collector of which is connected to the reset line 112. The emitter of the transistor 136 is grounded through a parallel circuit of a resistor 138 and a capacitor 140 and also is connected to the base of the transistor 106.

The switch 110 may be associated with the "PLAY" button of the tape recorder 1 so that it will be turned on by depressing the "PLAY" button. The switches 114, 122 and 126 are connected in tandem to form a single 3PST switch associated with the "RECORD" button of the tape recorder so that they are opened by depressing the "RECORD" button. That is, the switches 114, 122 and 126 are open in the tape recorder record mode and are closed in the other modes of operation thereof. The reset output 116 is connected to the reset input 218 and the reset input 318. The reset output 216 is connected to the reset input 118 and the reset input 320. Likewise, the reset output 316 is connected to the reset input 120 and the reset input 220.

The second and third switching circuits 20 and 30 are generally the same as the first switching circuit 10, except that the second and third switching circuits lack corresponding switches 114, 122 and 126. Accordingly, parts which perform the same function have been given the same reference character but with the addition of 200 thereto for the second switching circuit 20 and 300 thereto for the third switching circuit 30, and, therefore, will not be described further.

The operation of the switching circuit of this invention will now be described. It is assumed first that all of the electric devices 1, 2 and 3 are turned off. To place the tape recorder 1 in one of its modes other than the recording mode, an operator depresses the switch 110 and turns it on. This renders the transistor 104 conductive to permit current flow through the latch relay coil 102*a*, thereby changing the relay switch 102*b* to its ON position to couple the tape recorder 1 to the battery 4.

When placing the radio tuner 2 in operation in this state of the circuit, the operator depresses the switch 210 and turns it on. The transistor 204 then conducts current flow through the latch relay coil 202*a* to change the relay switch 202*b* to its ON position to connect the radio tuner 2 to the battery 4. Simultaneously, the battery is coupled through the reset line 212 to the reset output 216 which in turn is connected through the switch 122 and the diode 124 to the differentiating circuit 130 and also through the diode 328 to the differentiating circuit 330. The output of the differentiating circuit 130 is applied to the base of the transistor 136, the collector of which is coupled through the relay switch 102*b* to the battery, to temporarily render it conductive to rapidly charge the capacitor 140. The capacitor 140 is then discharged through the resistor 138. For the period during which the capacitor 140 discharges through the resistor 138, the transistor 106 becomes conductive to permit current flow through the latch relay coil 102*a*. This changes the relay switch 102*b* from the ON position to the OFF position to disconnect the tape recorder 3 from the battery 4. Although the output of the differentiating circuit 330 is applied to the base of the transistor 336, the capacitor 314 remains uncharged and thus the transistor 306 remains non-conductive since the relay switch 302*b* is in its OFF position and the collector of the transistor 336 is disconnected from the battery. As a result, the relay switch 302*b* remains in its OFF position to disconnect the television tuner 3 from the battery 4.

When the switch 310 is then depressed for placing the television tuner 3 in operation, the transistor 304 conducts current flow through the latch relay coil 302*a* to change the relay switch 302*b* to its ON position to connect the television tuner 3 to the battery 4. At the same time, the battery is connected through the reset line 312 to the reset output 316 which in turn is connected through the switch 126 and the diode 128 to the differentiating circuit 130 and also through the diode 228 to the differentiating circuit 230. Since the collector of the transistor 136 is disconnected from the battery, in this state of the circuit, the transistor 106 remains non-conductive and the relay switch 102*b* remains in the OFF position. On the other hand, the transistor 236, which has its collector coupled through the relay switch 202*b* to the battery, becomes conductive to charge the capacitor 240. Accordingly, for the period during which the capacitor 240 discharges through the resistor 238, the transistor 206 conducts current flow through the latch relay coil 202*a*, whereby the relay switch 202*b* is changed from the ON position to the OFF position to disconnect the radio tuner 16 from the battery.

To stop the operation of the television tuner 3 in this state of the circuit, the operator may depress the switch 310 again. This causes the transistor 304 to conduct current flow through the latch relay coil 302*a* to change the relay switch 302*b* from the ON position to the OFF position to disconnect the television tuner 3 from the battery.

When placing the tape recorder 1 in its record mode, the operator depresses the "PLAY" button and the "RECORD" button simultaneously. Depressing the "PLAY" button causes the switch 110 to turn on to connect the tape recorder 1 to the battery in the same manner as described hereinbefore. Depressing the "RECORD" button causes the switch 114 to open to disconnect the reset line 112 from the reset output 116, and also causes the switches 122 and 126 to open to disconnect the reset inputs 118 and 120 from respective diodes 124 and 128. This permits either the radio or television tuner to operate with the tape recorder 1 held in its record mode of operation.

For example, when the operator depresses the switch 210 associated with the radio tuner 2 while the tape recorder 1 is held in its record mode, the relay switch 202*b* changes to its ON position to simultaneously connect the radio tuner 2 and the reset output 216 to the battery. In this state of the circuit, the switch 122 is open to prevent the reset signal from the reset output 216 so that the tape recorder 1 remains in its record mode and records the output of the radio tuner 2.

When the operator then depresses the switch 310 associated with the television tuner 3, the relay switch 302*b* changes to the ON position to connect the battery to the television tuner 3 and the reset output 316 through the reset line 312. The voltage at the reset output 316 is applied as a reset signal to the signal switching circuit reset input 220 to change the relay switch 202*b* to the OFF position to disconnect the radio tuner 16 from the battery. Although the reset signal is also applied to the first switching circuit reset input 120, the switch 126 is open to block the reset signal to the diode 128 so that the tape recorder 1 remains in its record mode and records the output of the television tuner 3.

If the operator depresses the switch 310 and turns it on again in this state of the circuit, current flow occurs through the latch relay coil 302*a* to cause the relay switch 302*b* to change to the OFF position to disconnect the television tuner 3 from the battery. Thus, the tape recorder 1, which is held in its record mode until the switch 110 is depressed again, can be used to record the output of another source such as a microphone.

For example, if the tape recorder 1 is placed in its record mode after the switch 210 is depressed to change the relay switch 202*b* to the ON position to connect the radio tuner 2 to the battery, then the switch 110 is turned on to change the relay switch 102*b* to the ON position to connect the battery to the tape recorder 1 and to the reset line 112, and simultaneously, the switch 114 opens to block the reset signal from the first switching circuit 10 to the second switching circuit 20. This permits the radio tuner 2 to operate with the tape recorder 1 held in its record mode so that it can record the output of the radio tuner 2.

To place the tape recorder 1 in its record mode, the operator depresses both the "PLAY" and "RECORD" buttons. If the "PLAY" button switch is turned on before the "RECORD" button switch, the switch 110 will turn on to provide a reset signal to the second switching circuit 20 to place the radio tuner 2 out of operation before the switch 114 opens to block the reset signal. This situation can be eliminated by associating the switches 114, 122 and 126 with the "RECORD" button switch so that they open while the "RECORD" button switch is being depressed toward its ON position, but before it reaches its ON position.

It is therefore apparent that the present invention permits an operator to place a desired one of a number of electric devices in operation by a single operation. Actuation of a switch associated with the desired electric device causes that device to operate and the other electric devices to remain off. Means is provided for permitting another electric device to operate when a selected device is in a predetermined mode of operation. For example, this permits a radio or television tuner to operate with a tape recorder held in a record mode so that the tape recorder can record the output of the radio or television tuner.

While the present invention has been described in conjunction with a specific embodiment thereof, it is evident that many alternatives, modifications and variations will be apparent to those skilled in the art. Accordingly, it is intended to embrace all alternatives, modifications and variations that fall within the spirit and broad scope of the appended claims.

What is claimed is:

1. A switching system for selectively connecting a plurality of electric devices to a power source, comprising:

(a) a plurality of switching circuits associated with respective said electric devices, each of said switching circuits being operable to connect its associated electric device to said power source while simultaneously placing the other switching circuits out of operation; and (b) a holding circuit for holding a switching circuit associated with one of said electric devices in operation while permitting another switching circuit to operate when said one electric device is in a predetermined mode of operation.

2. A switching system according to claim 1, wherein each of said switching circuits comprises:

(a) first switching means having a first condition for connecting its associated electric device to said power source and a second condition for disconnecting said associated electric device from said power source, said first switching means adapted to alternatively change between said first and second conditions each time a drive signal is applied thereto;

(b) second switching means for providing a drive signal to said first switching means when actuated;

(c) reset signal generator means responsive to a first condition of said first switching means for providing a reset signal; and (d) third switching means responsive to a reset signal from said reset signal generator means of the other switching circuits for providing a drive signal to said first switching means only when said first switching means is in its first condition.

3. A switching system according to claim 2, wherein said holding circuit comprises fourth switching means responsive to a predetermined mode of operation of one of said electric device for blocking the reset signal from said reset signal generator means of said switching circuit associated with said one electric device to the other third switching means, and also for blocking the reset signal to said third switching means of said switching circuit associated with said one electric device.

4. A switching system according to claim 3, wherein said one electric device is a tape recorder and said predetermined mode is a record mode.

* * * * *